United States Patent [19]

Konle

[11] Patent Number: 4,509,292

[45] Date of Patent: Apr. 9, 1985

[54] DOOR GASKET

[75] Inventor: Robert L. Konle, New Berlin, Wis.

[73] Assignee: Arthur Smith Industries, Inc., New Berlin, Wis.

[21] Appl. No.: 471,881

[22] Filed: Mar. 3, 1983

[51] Int. Cl.[3] ..... E06B 7/16

[52] U.S. Cl. ..... 49/499; 49/70; 49/485

[58] Field of Search ..... 49/70, 485, 490, 492, 49/499

[56] References Cited

U.S. PATENT DOCUMENTS 3,055,193 9/1962 Smith ..... 49/70 X 3,141,204 7/1964 Wheeler ..... 49/499 X

*Primary Examiner*—Kenneth Downey

*Attorney, Agent, or Firm*—Quarles & Brady

[57] ABSTRACT

An improved door gasket comprises a snap base having a pair of oppositely facing flanges. Running along the web of the snap base between the snap flanges is a pair of catches which each mate with a complimentary one of a pair of depending latches on a snap channel when the snap channel is pressed against the snap base. A strip of elastomeric gasket material is wedged at each of its lateral edges between a separate one of the snap base flanges and the snap channel flanges to form a half rounded deformable sealing body. Although the snap channel is thus firmly held to the snap base by the engagement of the snap base catches and the snap channel latches, easy separation of the snap base and snap channel is accomplished by simply prying the snap channel from the snap base to facilitate gasket strip replacement. To keep the gasket material supple, a pair of electric heater wires are secured by a metal bracket to the snap channel to lie within the void of the half rounded deformable body, thereby trapping the heat within the deformable body to achieve efficient heating of the gasket strip.

10 Claims, 4 Drawing Figures

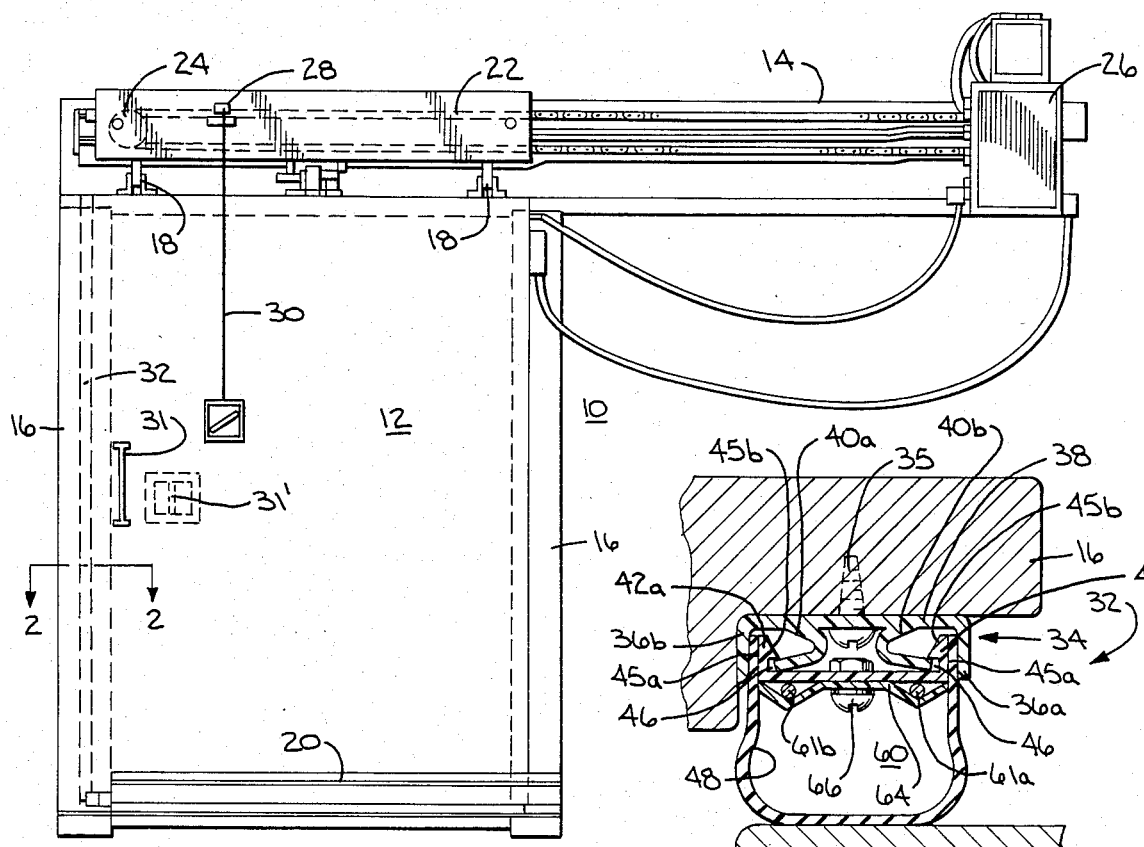
FIG. 1
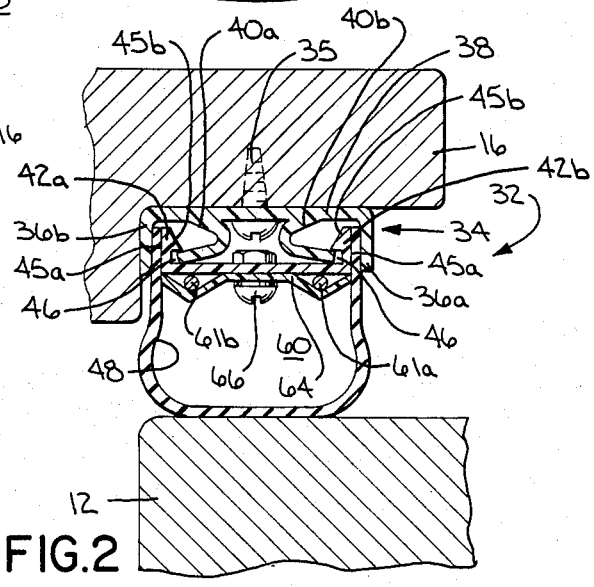
FIG. 2
FIG. 4
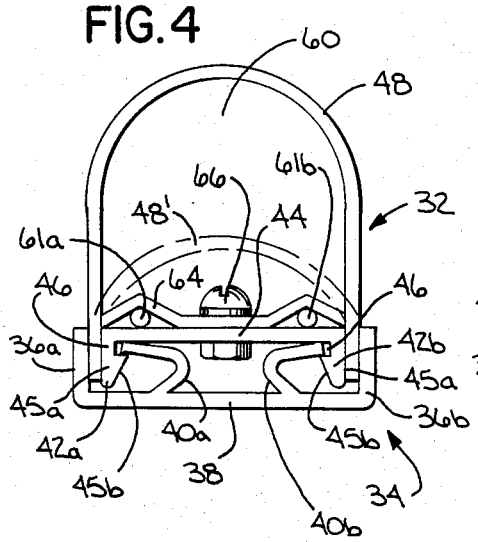
FIG. 3
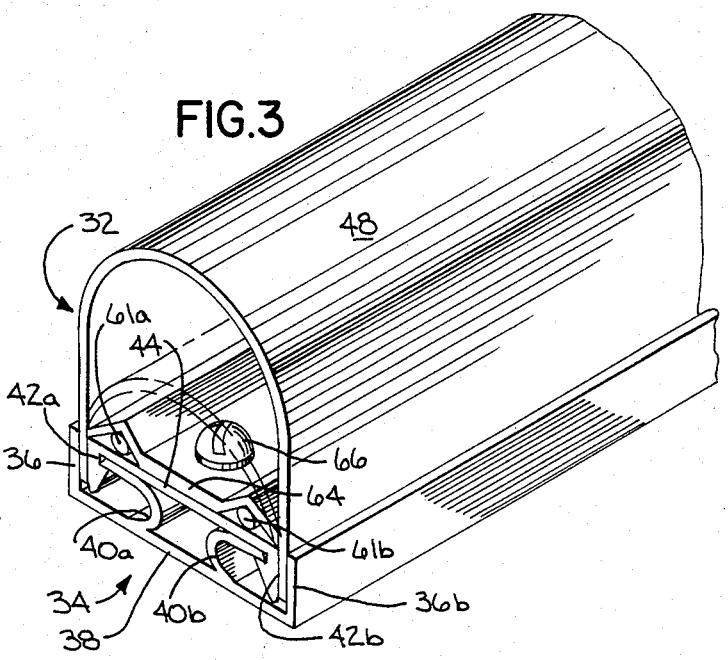

DOOR GASKET

BACKGROUND OF THE INVENTION

This invention relates generally to elastomeric door gaskets and more particularly to an elastomeric door gasket for a cold storage door or the like.

In the fabrication of doors for environmental enclosures such as freezers, cold storage lockers and coolers, an airtight seal between the door and the door frame of the environmental enclosure is desirable so that the temperature of the environmental enclosure interior can be maintained substantially constant. To achieve a substantially airtight seal between the cold storage door and the door frame, an elastomeric gasket is usually mounted to either the door frame or to the door so that the gasket abuts the door or door frame, respectively, to eliminate any void between the door and door frame.

Present day elastomeric door gaskets for cold storage doors generally include a gasket base which is affixed either to the jamb of the door frame or to the outer edge of the door. A strip of elastomeric gasket material has a separate one of its lateral edges fastened at opposite edges of the gasket base so that the gasket strip is deformed in the shape of a half-rounded body. It is this half-rounded body which is deformed when the door is brought into contact with the door jamb upon closing to provide a seal between the door and door frame. To impart rigidity to this deformable gasket strip body, a foam rubber tube or the like is inserted into the void between the gasket strip and the gasket base.

In the past, two different types of cold storage door gasket constructions have been utilized. One type of prior art cold storage door gasket includes a gasket base which takes the form of a web having a pair of oppositely disposed, upstanding flanges. The elastomeric gasket strip is secured by adhesive at each of its lateral edges to one of the two depending flanges of a gasket channel which is then pressed between the flanges of the gasket base, thereby wedging the gasket strip between the flanges of the gasket base and the gasket channel. Mechanical fasteners, such as self tapping screws, extend through the flanges of the gasket base and gasket channel to secure the gasket channel to the gasket base.

Another type of prior art cold storage door gasket employs a gasket base having a pair of spaced apart upwardly rising channels running along the length of the gasket base. The lateral edges of the strip of gasket material, each carry a bead which is dimensioned to be slidably received within a separate one of the channels of the gasket base. In this way, the elastomeric gasket strip is retained in the gasket base.

Regardless of which type of prior art gasket construction is utilized with a cold storage door, repeated closing of the cold storage door, and the resultant deformation of the half-rounded gasket strip body usually results in significant wear of the gasket strip. Eventually, replacement of the gasket strip of the door gasket becomes necessary. To facilitate replacement of the elastomeric gasket strip of first described type of prior art door gasket, the mechanical fasteners which secure the gasket channel to the gasket base must be removed. Only after the mechanical fasteners have been removed can the gasket strip be separated from the gasket channel to allow a new gasket strip to be installed. With the other type of prior art door gasket, the gasket strip must be completely slid from the gasket base so that each of the beads on the lateral gasket edges no longer engage the gasket channels. Once this is completed, a new strip of gasket material can be installed.

Irrespective of which of the two above-described types of prior art door gaskets are installed on a cold storage door, replacement of the door gasket strip is generally difficult and time consuming. In particular, replacement of the gasket strip of either type of prior art cold storage gasket becomes very difficult when the gasket is mounted at the base of the cold storage door. Oftentimes, there may be insufficient clearance to allow removal of any mechanical fasteners or sliding of the gasket strip.

Another problem associated with prior art cold storage door gaskets is the manner in which the gasket strip is heated to keep it supple at low temperatures. In the past, the gasket strip of prior art cold storage door gaskets has been heated by an electric strip heater which is mounted either on the door or on the jamb of the door frame to abut the gasket strip when the door is closed. While the prior art gasket strip heaters accomplish gasket strip heating they do so only when the door is closed. Moreover, the external heating of the gasket strip by prior art gasket heaters results in considerable heat loss to the atmosphere. Such heat loss results in wasted energy and hence higher operating costs for the cold storage door.

In contrast to the prior art door gaskets, the present invention concerns an improved door gasket whose elastomeric strip member may be readily replaced without the need to slide the gasket strip from the gasket base or to remove any separate mechanical fasteners securing the gasket base to the gasket channel. Moreover, the improved door gasket of the present invention is provided with a heater disposed interior of the half-rounded elastomeric gasket strip body created when the lateral edges of the gasket strip are secured to the gasket base. The location of the heater within the gasket strip body void assures efficient gasket strip heating.

BRIEF SUMMARY OF THE INVENTION

Briefly, in accordance with the preferred embodiment of the invention, an improved door gasket for a cold storage door or the like comprises a snap base having a pair of oppositely disposed catches rising upwardly therefrom. Each snap base catch is configured to engage a separate one of a pair of spaced apart latches depending from a snap channel when the snap channel is pressed against the snap base to mate the snap channel latches with the snap base catches. Each of the lateral edges of a strip of elastomeric gasket material is secured, to a separate one of the edges of the snap channel to create a half rounded gasket strip body which is deformable either by the door or the door frame jamb to seal the void therebetween when the door is closed. Engagement of the catches on the snap base with the latches on the snap channel thus assures firm engagement of the snap channel with the snap base, yet allows the snap channel to be separated from the snap base by prying the snap gasket channel from the gasket base. In this way easy removal of the gasket strip is facilitated.

The improved cold storage door gasket of the present invention is also characterized by an improved gasket strip heater secured to the gasket channel so as to be interior of the half-rounded gasket strip body, thereby assuring efficient gasket strip heating. In practice, the improved gasket strip heater takes the form of heater wires located within the gasket so as to be between the half-rounded gasket strip and the snap channel base. Typically, the heater wires run along the snap channel and a wire clamp secured to the snap channel by mechanical fasteners to clamp the wires to the snap channel and maintain the heater wires in spaced apart relationship.

An object of the present invention is to provide an improved cold storage door gasket which facilitates ready removal of the elastomeric gasket strip. This is readily accomplished in the door gasket of the present invention by virtue of the releasable engagement between the latches of the snap channel which mounts the gasket strip and the catches on the snap base which secures the gasket to the door or the door frame.

Another object of the present invention is to provide an elastomeric door gasket for a cold storage door having an improved gasket heater. This is readily accomplished by the gasket of the present invention which includes heater wires located within the gasket so that the heater wires are interior of the half rounded body formed when the gasket is secured at its lateral edges to the snap channel.

Other objects and advantages of the present invention will become apparent following the description thereof.

BRIEF SUMMARY OF THE DRAWINGS

The features of the invention believed to be novel are set forth with particularity in the appended claims. The invention itself, however, both as to organization and method of operation, together with further objects and advantages thereof may best be understood by reference to the following description taken in conjunction with the accompanying drawings in which:

FIG. 1 is a schematic view of a sliding cold storage door which mounts the improved elastomeric door gasket of the present invention;

FIG. 2 is a cross sectional view taken along lines 2—2 of FIG. 1;

FIG. 3 is a perspective view of the door gasket of the present invention; and FIG. 4 is an end view of the door gasket of FIG. 3.

DETAILED DESCRIPTION OF THE PREFERRED EMBODIMENT

Referring now to FIG. 1, there is shown a door assembly 10 which includes a door 12 slidably mounted on a track 14 for slideward movement. In the figure, door 12 is shown in a closed position to overlie the opening in door frame 16. To achieve sliding movement of door 12, the door is hung from track 14 by door trucks 18 which each include bearing wheels (not shown) for engaging track 14. At the bottom of door 12 is a flange 20 which bears against a guide wheel (not shown) secured to the floor adjacent to the door frame to guide the door as it is slid along track 14.

To propel door 12 between its open and closed position an endless drive chain 22 is looped about idler wheels 24 (only one of which is shown) journaled into track 14. The chain 22 is driven by a hydraulic drive mechanism 26 which typically takes the form of the drive mechanism described and claimed in U.S. Pat. No. 4,296,570 issued to George Ballbach, et al. and assigned to the assignee of the present invention. A chain pickup clamp 28 is connected to door 12 and releasably engages chain 22 to permit the door to be displaced along track 14 as the chain is driven by drive mechanism 26. A safety release 30 is connected to pickup clamp 28 to disengage the chain pick-up clamp when the safety release 30 is actuated. Once safety release 30 is actuated to disengage door 12 from chain 24, door 12 can be manually moved to its open position by pulling on door handle 31. While door handle 31 typically takes the form of a protruding member, in certain instances, it may be desirable to substitute a recessed door handle 31' (shown in phantom) for the protruding member 31.

In practice, door 12 takes the form of a thermally insulated cold storage door suitable for sealing the opening into a cold storage or freezer door cell. Since considerable energy is usually expended to maintain the cold storage or freezer cell environment at a particular temperature, a good seal between door 12 and door frame 16 is thus essential to prevent undesirable leakage of air through openings between the door 12 and the door frame 16. To achieve a good seal between the door and the door frame, an improved door gasket 32, described in greater detail hereinafter, is secured to the jamb of the door frame 16 to abut the door 12 when the door is at its closed position. FIG. 2, which is a cross sectional view taken along lines 2—2 of FIG. 1, better illustrates the abutment of door 12 against the gasket 32 on the jamb of door frame 16 when the door is at its closed position.

Referring now to FIG. 2 and to FIGS. 3 and 4 which are perspective and end views of the door gasket 32, respectively, door gasket 32 is comprised of a snap base 34 which is secured to door frame 16 by screws 35. Snap base 34 is configured of an elongate U-shaped member having a pair of outwardly extending, oppositely disposed, flanges **36*a* and 36*b* coextensive with a central web section 38. Rising from the web section 38 of snap base 34 are a pair of opposed catches 40*a* and 40*b*. Each catch takes the form of an arcuate, resilient leg whose outwardmost edge faces the interior lateral edge of a separate one of flanges 36*a* and 36*b*, respectively. In practice, the snap base 34 is extrusion-molded from a suitable polymer resin, such as polyvinyl chloride, so that legs 40*a* and 40*b* and flanges 36*a* and 36*b* are integral with web portion 38**.

The end of each of legs **40*a* and 40*b* is spaced a short distance from the inner lateral edge of the respective flanges 36*a* and 36*b* so that a space exists between each base leg and a corresponding base flange. The space between each of legs 40*a* and 40*b* and corresponding one of flanges 36*a* and 36*b* enables a separate one of the depending latches 42*a* and 42*b* of a snap base 44 to be received between base leg 40*a* and flange 36*a* and between base leg 40*b* and flange 36*b*, respectively, when the snap channel is pressed against, that is to say, mated with the snap base. In practice, each of the latches 42*a* and 42*b* of snap channel 44 takes the form of a finger having a straight outer edge 45*a* and an inwardly tapered inner edge 45*b* which terminates at a ledge 46 as best illustrated in FIG. 4. The depth of the ledge 46 at the base of each of the inner edges of each of flanges 42*a* and 42*b* is selected so that only a very small portion of the outer edge of each of resilient legs 40*a* and 40*b* rests on the ledge 46 of a corresponding one of latches 42*a* and 42*b* when the snap channel is pressed into, the snap base. Like snap base 34, snap channel 44** is typically manufactured by extrusion molding a suitable polymer resin such as polyvinyl chloride or the like.

A deformable, elongate strip of elastomeric gasket material 48 is secured at each of its planar lateral edges to the outer surface **45*a* of a separate one of flanges 42*a* and 42*b* of snap channel 34 by adhesive cement or the like. In this way, gasket 48, which is typically made from Hypalon or polyurethane, is wedged between the snap base 34 and the snap channel 44 when the snap base is mated with the snap channel. The width of gasket strip 48 ultimately determines the height of gasket assembly 32. As illustrated in FIGS. 3 and 4, when a relatively wide strip of gasket material 48 is wedged at each of its lateral edges between a separate one of the flanges of the snap base 34 and the snap channel 44, a semi-rounded deformable gasket strip body is thus formed having an interior void 60. The half-rounded gasket strip body formed by deforming gasket strip 48 is of a height much larger than the height of the semi-rounded gasket body that would be formed by deforming a much narrower strip of gasket material 48'** (shown in phantom).

Returning now to FIG. 2, gasket 32 is secured to door frame 16 as follows. The snap base 34, while separated from the snap channel 44 and the elastomeric gasket strip 48 adhered thereto, is secured to the jamb door frame 16 by screws 35 so as to be adjacent to the outermost edge of the door 12. Once the snap base 34 is secured to the door frame 16, then the snap channel 44 is mated with the snap base 34 by pressing the snap channel against the snap base so that the resilient legs 40*a* and 40*b* on the snap base 34 each engage the ledge 46 at the base of the inner edge 45*b* of each of flanges 42*a* and 42*b* of the snap channel 44. Although the outer edge of each of the legs 40*a* and 40*b* of the snap base 34 each extend only a very short distance onto the ledge, the engagement of each of the catches with each latch together with the frictional engagement of the edges of gasket strip 48 between the inner edge of flanges 36*a* and 36*b* of the snap base 34 and the outer edge 45*a* of flanges 42*a* and 42*b* of the snap channel 44 assure a firm engagement between the snap channel 44 and the snap base 34. Thus, the need for any mechanical fasteners to secure the snap base 34 to the snap channel 44 is obviated. Yet, since each of the snap base legs 40*a* and 40*b* only extends a short distance onto the ledge 46 of a corresponding one of flanges 42*a* and 42*b* of the snap channel 44, the snap channel 44 can be readily pried from the snap base 34 by inserting a tool such as a screw driver therebetween to separate the snap channel 44 from the snap base 34. In this way, the gasket strip 48 can be readily replaced when necessary without the need to remove any mechanical fastening or to slide any members out from the base.

The relative ease to which snap channel 44 may be separated from snap base 34 makes the gasket assembly 32 very desirable for use not only on a sliding door as earlier described but also very desirable for use on overhead doors and the like where the gasket is typically mounted to the base of the door. In the past, mounting conventional door gaskets to the base of the door has presented difficulties when replacement of the elastomeric gasket strip becomes necessary. However, with gasket 32, the gasket strip 48 can be readily replaced by simply prying snap base 44 from snap channel 34, thereby making gasket strip replacement very easy.

Although gasket 32 is extremely useful for cold storage doors as described above, at very low temperatures, the gasket strip 48 may loose its ability to remain supple. Unlike prior art door gaskets which have utilized a strip heater external to the gasket for heating the elastomeric gasket strip to keep it supple, gasket 32 utilizes an internal heater which achieves greater efficiency. Referring jointly to FIGS. 3 and 4, running along the top surface of snap channel 44 are a pair of heater wires 61*a* and 61*b*. Wires 61*a* and 61*b* are held in a spaced apart relationship against the snap channel 44 by a clamp 64 secured to the top surface of snap channel 44 by suitable fasteners 66 such as a machine screw and nut. With the heater wires secured to the top surface of the snap surface channel 44 so that the heater wires lie within void 60 of the semi-rounded body formed by deforming the gasket strip 48, the heat produced by the heater wires 61*a* and 61*b*, when the heater wires are connected to a source of electric power (not shown), is thus trapped within the void. Greater efficiency is thus achieved in comparison to prior art gasket heaters which externally heat the elastomeric gasket strip of the door gasket. To keep the temperature relatively constant, a thermostatic switch (not shown) may be mounted to the upper surface of the wire clamp 64.

Although the wires 61*a* and 61*b* have been described as being clamped to the snap channel, the wires could simply be left unsupported within the void 60. Additionally, the wires could even be placed between the snap channel 44 and the snap base 34.

Another important attribute of door gasket 32 of the present invention is that the construction of the door gasket permits the use of conventional air sensing switches (not shown). Such air sensing switches, which are well known in the art for sensing air pressure variations, may be located in communication with the void 60 between gasket 48 and the snap channel 44 to sense variations in air pressure caused when the gasket strip 48 impacts an obstruction.

Although the door gasket 32 of the present invention has been described as being mounted to a door frame for sealing the opening between the door frame and a single sliding cold storage door, those skilled in the art can readily appreciate that the door gasket 32 may be utilized equally advantageously on other types of cold storage doors. In particular, the door gasket 32 may be employed on the abutting edges of each of a pair of double sliding cold storage doors or on the abutting edge of an overhead cold storage door or a hinged cold storage door.

While only certain featues of the invention have been shown by way of illustration, many modifications and changes will occur to those skilled in the art. It is, therefore, to be understood that the appended claims are intended to cover all such modifications and changes as fall within the true spirit of the invention.

What is claimed is:

1. An improved door gasket comprising:

a base having a pair of oppositely disposed catches rising therefrom and a pair of upstanding, opposing flanges;

a channel having a pair of depending, spaced apart latches, each said channel latch releasably engaging a corresponding one of said base catches when said channel is pressed against said base and each of said channel latches disengaging said corresponding one of said base catches when said channel is pried from said base; and a strip of deformable gasket material having a pair of planar lateral edges, each said lateral edge is fastened to one of said latches to create a half-rounded deformable body having an interior void and each said lateral edge being held between the channel latch and one of said base flanges.

2. An improved door gasket comprising:

a base having a pair of oppositely disposed catches rising therefrom;

a channel having a pair of depending, spaced apart latches, each said channel latch releasably engaging a corresponding one of said base catches when said channel is pressed against said base and each of said channel latches disengaging said corresponding one of said base catches when said channel is pried from said base; and a strip of deformable gasket material having a pair of lateral edges, each said lateral edge being fastened to said channel to create a half-rounded deformable body having an interior void;

said base having a pair of upstanding, opposing flanges, with each said flange exterior to a separate one of said base catches, said flanges being spaced apart a distance slightly greater than the distance between said channel latches, and each said lateral edge of said gasket strip being fastened to the edge of a separate one of said channel latches so that each of said lateral edges of said gasket strip is wedged between a separate one of said base flanges and said channel latches when said channel is pressed into said base.

3. The invention according to claim 1 wherein each of said base catches comprises a resilient leg coextensive with said base.

4. The invention according to claim 2 wherein each of said latches on said channel comprises a flange having a non-tapered outer surface, and a partially inwardly tapered inner surface having a notch at the base of said tapered inner surface for receiving a small portion of a separate one of said base legs when said channel is pressed into said base.

5. The invention according to claim 1 further including heating means within said gasket for heating said strip of gasket material to maintain said gasket material supple at low temperatures.

6. The invention according to claim 5 wherein said heating means comprises:

at least one heating wire running along the length of said channel; and clamp means for clamping said heating wire to said channel.

7. An improved door gasket for a cold storage door or the like comprising:

a snap base having a pair of upstanding, opposing, spaced apart flanges and a pair of opposing upwardly rising catches which are each spaced inwardly from a separate one of said flanges;

a snap channel having a pair of depending, opposing latches which are spaced apart a distance slightly less than the distance between said flanges of said snap base, each said snap channel latch releasably engaging a corresponding one of said snap base catches when said snap channel is pressed against said snap base and each said snap channel latch disengaging said corresponding one of said snap base catches when said snap channel is pried from said snap base;

a strip of deformable gasket material having a pair of lateral edges, each said lateral edge fastened to a separate one of said snap channel latches so as to be wedged between an opposing one of said pair of channel latches and base catches, thereby creating a semi-rounded deformable body having a void therein bounded along one side by said channel; and heater means within said gasket for heating said gasket strip to maintain said gasket strip supple at low temperatures.

8. The invention according to claim 7 wherein each of said base catches includes a resilient leg coextensive with said base.

9. The invention according to claim 8 wherein each of said channel latches includes a flange coextensive with said channel, said flange having an outer non-tapered surface and an inner inwardly tapered surface, said inwardly tapered surface having a notch therein for receiving a small portion of said base catch.

10. The invention according to claim 8 wherein said heater means comprises:

at least one heating wire extending along the length of said channel; and clamp means for clamping said heating wire to said channel.

* * * * *